United States Patent [19]

Caldwell et al.

[11] 4,369,105

[45] Jan. 18, 1983

[54] SUBSTITUTED COBALT OXIDE SPINELS

[75] Inventors: Donald L. Caldwell; Mark J. Hazelrigg, Jr., both of Lake Jackson, Tex.

[73] Assignee: The Dow Chemical Company, Midland, Mich.

[21] Appl. No.: 247,429

[22] Filed: Mar. 25, 1981

[51] Int. Cl.[3] ..... C25B 11/06

[52] U.S. Cl. ..... 204/290 F; 204/290 R; 204/291; 427/126.5; 427/126.6; 429/218

[58] Field of Search ..... 204/290 F, 290 R, 291; 252/425.3; 427/126.5, 126.6; 429/218, 222

[56] References Cited

U.S. PATENT DOCUMENTS 4,061,549 12/1977 Hazelrigg et al. ..... 204/98

4,125,449 11/1978 Lewis et al. ..... 204/290 F

*Primary Examiner*—F. Edmundson

*Attorney, Agent, or Firm*—W. J. Lee

[57] ABSTRACT

Electroconductive substrates are coated with an interface layer and then with cobalt oxide spinels conforming substantially to the empirical formula $$M_xZ_yCo_{3-(x+y)}O_4$$

where M represents at least one metal from the Groups IB, IIA, IIB, where Z represents at least one metal from Group IA where x is equal to or greater than zero but not greater than 1, where y is equal to or greater than zero but not greater than 0.5, and where (x plus 2y) is equal to or greater than zero but not greater than 1. The composites are prepared by thermally oxidizing metal oxide precursors in-situ on the substrate, including, optionally, modifier metal oxide materials as a separate dispersed phase in the contiguous spinel structure. The interface layer comprises at least one oxide of Pb, Sn, Sb, Al, In, or mixtures of these.

20 Claims, 1 Drawing Figure

SUBSTITUTED COBALT OXIDE SPINELS

BACKGROUND OF THE INVENTION

Figure 1:
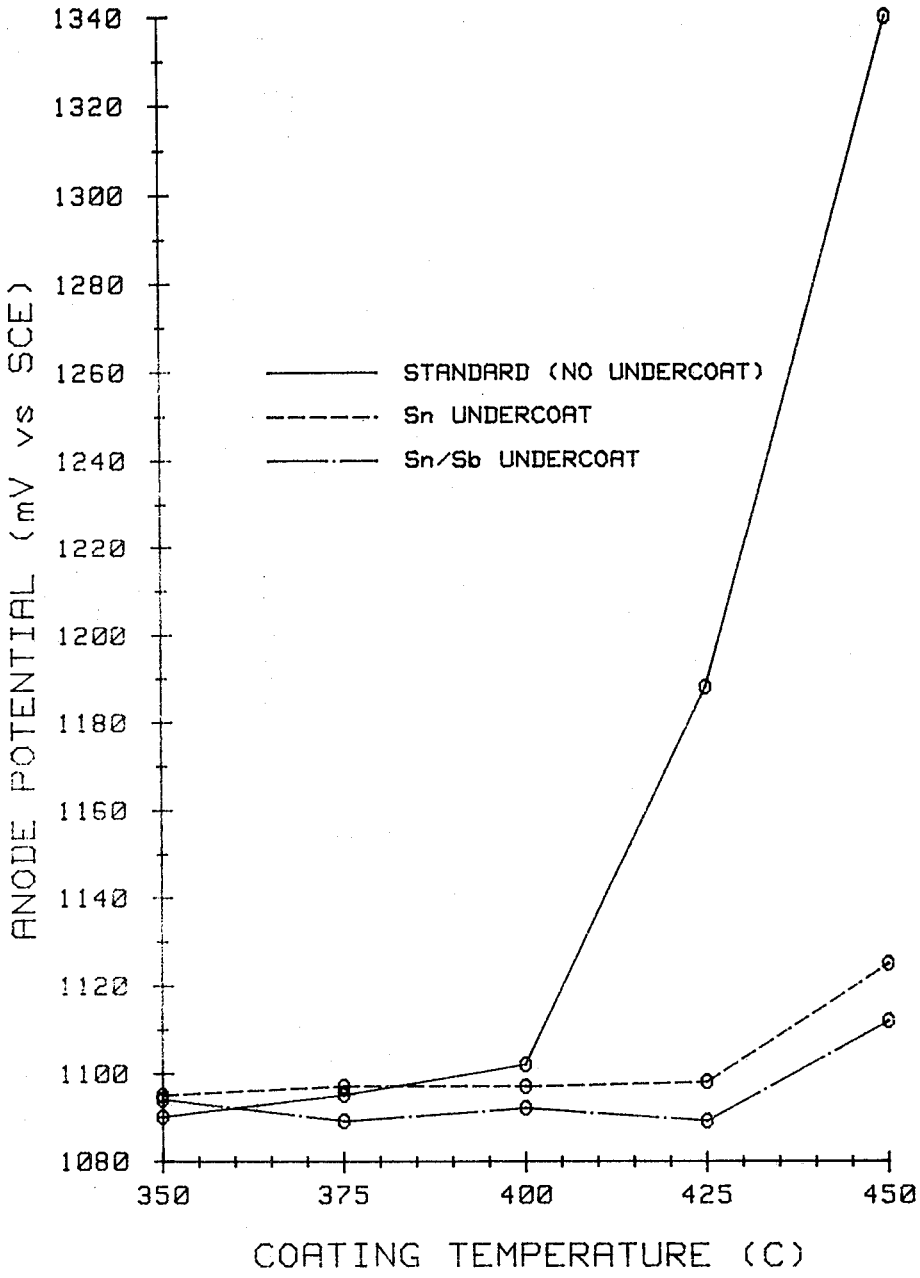

Various cobalt oxide spinels coated onto electrically-conductive substrates, especially for use as anodes in brine electrolysis, are known. Of particular relevancy are U.S. Pat. Nos. 3,977,958; 4,061,549; and 4,142,005; all of which are incorporated herein by reference.

Also of various degrees of relevancy are U.S. Pat. Nos. 4,073,873; 3,711,382; 3,711,397; 4,028,215; 4,040,939; 3,706,644; 3,528,857; 3,689,384; 3,773,555; 3,103,484; 3,775,284; 3,773,554; 3,632,498; and 3,663,280.

SUMMARY OF THE INVENTION

An insoluble anode for electrolysis, especially electrolysis of brine solutions, is prepared by coating an electroconductive substrate with a first coating comprising one or more oxides of the group of metals consisting of Sn, Pb, Sb, Al, and In, and then an outer coating comprising an effective amount of a monometal or polymetal oxide having a spinel structure conforming substantially to the empirical formula comprising $M_xZ_yCo_{3-(x+y)}O_4$, where $0 \leqq x \leqq 1$, $0 \leqq y \leqq 0.5$, $0 \leqq (x+2y) \leqq 1$, where M represents at least one metal of Groups IB, IIA, and IIB of the Periodic Table and where Z represents at least one metal of Group IA. The spinel coating optionally contains a modifier metal oxide. The coating is prepared by applying a fluid mixture of the metal oxide precursors to the substrate and heating under oxidizing conditions at a temperature in a range effective to form the first coating and the second (spinel) coating in-situ on the substrate. A "polymetal" cobalt spinel is used herein to describe a spinel containing a plurality of metals, of which cobalt is one.

FIG. 1 illustrates data from only certain embodiments described hereinafter.

DESCRIPTION OF THE INVENTION

Cobalt oxide based anode coatings of the spinel type are sensitive to preparation temperature. Anodes prepared at temperatures above 450° C. tend to have high operating potentials in service; furthermore, these potentials tend to increase more rapidly than those of anodes prepared at lower temperatures. It has unexpectedly been found that the anodes of the present invention are more tolerant of high preparation temperatures than are those of the prior art. A high temperature yields a tougher, more highly sintered active coating, and is thus desirable, if low operating potentials can be maintained.

It is believed that the cobalt oxide based anode coatings of the spinel type are sufficiently permeable to oxygen at elevated temperatures that oxidation of the electroconductive substrate (typically a valve metal such as titanium) can take place during the coating operation. It is well known that valve metal oxides are poor electrical conductors in the anodic direction; thus such high-temperature anodes have undesirably high resistances and thus high operating potentials.

It is believed that the interface layer of the present invention functions by reacting with the valve metal oxide as it is formed on the surface of the substrate, rendering it electrically conductive. The mechanism by which this is accomplished is uncertain. Trivalent metals such as indium may function as conventional semiconductor dopants in the (tetravalent) valve metal oxide lattice; tetravalent metals such as tin may form conductive solid solutions with the valve metal oxide, analogous to $RuO_2$-$TiO_2$ solid solutions.

One feature that distinguishes the present invention from interface layers of platinum group metals and/or oxides is that the interface materials of the present invention cannot in themselves form the basis of an operable anode coating: tin oxide can be used as a dopant in solid solution anode coatings but is insufficiently stable to be used alone, and antimony and indium oxides are highly reactive in typical brine electrolysis anolyte. It is thus unexpected that their presence in interface layers stabilizes the operation of anodes in brine electrolysis.

In general, the first metal oxide coating is prepared on a cleaned, oxide-free, electroconductive substrate, such as titanium, by applying to the substrate a layer of precursor metal compound which, when thermally decomposed in air, yields the oxide of the metal affixed in-situ on the substrate. More than one metal oxide precursor may be used simultaneously, so long as the precursor compound is at least one thermally decomposable compound of Sn, Pb, Sb, Al, In or mixtures of these. The precursor may be a metal-organic, or otherwise contain organic moieties, but is preferably an inorganic compound. It is preferred that the precursor metal compound be carried in a liquid medium, such as water, alcohol, water/alcohol, water/acetone, and the like; preferably the precursor metal compound is soluble in the liquid medium. During the heating step of the process the liquid carrier is boiled away and plays no further part in the process. The steps of applying the metal oxide precursors, followed by heating to create the metal oxides, is beneficially repeated one or more times, thereby assuring that a contiguous well-adhered coating of the metal oxide is obtained, though only one coat is operable. It is best if this metal oxide underlayer has a thickness in the range of about 20–400 Å, coatings as thin as about 10 Å demonstrate operability as to coatings thicker than 400 Å but there are no additional benefits to be derived from such thicker coatings which are commensurate with the expense of laying down such thicker coatings. The temperature used in forming the metal oxide underlayer may be from the decomposition temperature (in air) of the metal oxide precursor to as high as several hundred degrees centigrade, preferably a temperature in the range of about 200° C. to about 450° C., most preferably about 250°–450° C. The baking time is generally in the range of about 1.5 to about 60 minutes, the higher temperatures requiring the lesser times. Excess time at the higher temperatures can lead to unwanted oxidation of the substrate.

In general, the spinel coating is prepared in-situ on the so-coated electroconductive substrate by applying a fluid mixture (preferably a solution) of the spinel-forming precursors along with, optionally, any modifier metal oxide precursors desired, to the coated substrate, then heating at a temperature and for a time effective to produce the spinel structure as a layer or coating on the pre-coated substrate. The spinel coating is found to form a contiguous, well-adhered layer on the undercoating of metal oxide applied first.

The temperature effective in producing the spinel structure is generally in the range of about 200° C. to about 475° C., preferably in the range of about 250° C. to about 400° C. At temperatures below about 200° C. the formation of the desired spinel structure is likely to be too slow to be feasible and it is likely that substantially no spinel will be formed, even over extended periods of time. At temperatures above about 475° C. there is likely to be formed other cobalt oxide structures, such as cobaltic oxide ($Co_2O_3$) and/or cobaltous oxide (CoO), whether substituted or not. Any heating of the spinel above about 450° C. should be of short duration, say, not more than about 5 minutes, to avoid altering the desired spinel structures to other forms of the metal oxides. Any modifier metal oxides present, being contained in the spinel structure as a different phase, will be formed quite well at the spinel-forming temperatures and any variations in the oxide form of the modifier metal oxides are not significant in the present invention. By using the undercoat prescribed in the present invention, the preferred temperature range for formation of the spinel topcoat becomes about 400° C.–450° C., most preferably about 400° C.–425° C.

The length of time at which the heating is done to form the spinel structure is, generally, inversely related to the temperature. At lower temperatures within the prescribed range, the time may be as much as 8 hours or more without destroying the spinel structure or converting substantial amounts of it to other oxide forms. At the upper end of the prescribed heating range, the time of heating should not be extended beyond the time needed to form the desired spinel structure because extended heating times may destroy or convert a substantial amount of the spinel to other oxide forms; at the upper end of the range a heating time in the range of about 1 minutes to about 5 minutes is generally satisfactory in forming the spinel without forming other oxide forms.

The substrates of interest in the present invention are electroconductive metals comprising the valve metals or film-forming metals which includes titanium, tantalum, zirconium, molybdenum, niobium, tungsten, hafnium, and vanadium or alloys thereof. Titanium is especially preferred as a substrate for preparing anodes to be used in electrolysis of brine.

The precursor cobalt compounds used in making the present spinel structures may be any thermally-decomposable oxidizable compound which, when heated in the prescribed range, will form an oxide of cobalt. The compound may be organic, such as cobalt octoate or cobalt 2-ethyl hexanoate and the like, but is preferably an inorganic compound, such as cobalt nitrate, cobalt hydroxide, cobalt carbonate, and the like. Cobalt nitrate is especially preferred.

The precursor metal compounds of Groups IA, IB, IIA, and IIB and of the modifier metal oxides (if used) may be any thermally-decomposable oxidizable compound which, when heated in the prescribed range, will form oxides. Organic metal compounds may be used, but inorganic metal compounds are generally preferred.

Modifier oxides may be incorporated into the substituted or unsubstituted $Co_3O_4$ coating to provide a tougher coating. The modifier oxide is selected from among the following listed groups:

Group III-B (Scandium, Yttrium)
Group IV-B (Titanium, Zirconium, Hafnium)
Group V-B (Vanadium, Niobium, Tantalum)
Group VI-B (Chromium, Molybdenum, Tungsten)
Group VII-B (Manganese, Technetium, Rhenium)
Lanthanides (Lanthanum through Lutetium)
Actinides (Actinium through Uranium)
Group III-A Metals (Aluminum, Gallium, Indium, Thallium)
Group IV-A Metals (Germanium, Tin, Lead)
Group V-A Metals (Antimony, Bismuth).

The modifier oxide is, preferably, an oxide of cerium, bismuth, lead, vanadium, zirconium, tantalum, niobium, molybdenum, chromium, tin, aluminum, antimony, titanium, or tungsten. Mixtures of modifier oxides may also be used.

Most preferably, the modifier oxide is selected from the group consisting of zirconium, vanadium, and lead, or mixtures of these, with zirconium being the most preferable of these.

The amount of modifier oxide metal or metals may be in the range of zero to about 50 mole %, most preferably about 5 to about 20 mole % of the total metal of the coating deposited on the electroconductive substrate. Percentages, as expressed, represent mole percent of metal, as metal, in the total metal content of the coating. The modifier oxide is conveniently prepared along with the substituted or unsubstituted $Co_3O_4$ from thermally decomposable oxidizable metal compounds, which may be inorganic metal compounds or organic metal compounds.

The carrier for the precursor metal compounds is preferably water, a mixture of water/acetone, or a mixture of water and a water-miscible alcohol, e.g., methanol, ethanol, propanol, or isopropanol. The carrier is one which readily evaporates during spinel formation. The precursor metal compounds are preferably soluble in the carrier or at least in very finely-divided form in the carrier. Solubilizing agents may be added to the mixture, such as ethers, aldehydes, ketones, tetrahydrofuran, dimethylsulfoxide, and the like. In some instances, adjustments to the pH of the mixture may be made to enhance the solubility of the metal compounds, but attention should be given to whether or not the pH adjuster (acid or base) will add any unwanted metal ions. Ammonia is generally the best alkalizer since it does not add metal ions.

The procedure for preparing the coatings comprises starting with a clean substrate with surface oxides and contaminants substantially removed, at least on the surface(s) to be coated, then applying the interface coating as described above. The mixture of metal oxide spinel precursors in a liquid carrier is applied to the substrate, such as by dipping, spraying, brushing, painting, or spreading. The so-coated substrate is subjected to a temperature in the prescribed range for a period of time to thermally oxidize the metal compounds to oxides, thereby forming, on the interface coating, the spinels of the present invention, along with any modifier metal oxides or second-phase metal oxides which may be co-prepared but which are not part of the expanded cobalt oxide spinel crystal structure. Generally, the first such application (which usually gives a relatively thin layer) is done quickly to avoid the risk of excessive oxidation of the substrate itself. Then as additional applications are made (i.e., applications of the precursor liquid carrier containing the metal compounds, followed by thermal oxidation) the thickness of the coating builds up, becomes tighter and denser, and there is a substantially reduced risk of excessively oxidizing the substrate under the interface coating and the spinel coating. Each subsequent layer is found to combine quite readily to preceding layers and a contiguous spinel coating is formed which is adhered quite well to the interface on the substrate. It is preferred that at least 3 such layer-applications are employed, especially from about 6 to about 12 such layer-applications.

It is best to charge the initial mixture of metal compounds into the liquid carrier in such a way that the desired ratio of metals are present on a molar basis to satisfy the stoichiometry of the desired polymetal cobalt spinel, also referred to herein as expanded cobalt spinel or substituted cobalt spinel.

The following enumerated paragraphs are presented to offer a simplified explanation, based on belief and experience, of what transpires when one or more monovalent or divalent metal ions replace a portion of the cobalt ions in a cobalt oxide spinel, but the invention is not meant to be limited by, or confined to, this simplified explanation. This explanation is intended to cover metals of Groups IA, IIA, IB, and IIB insofar as replacement of cobalt ions in a cobalt oxide spinel structure is concerned.

1. A "single-metal" cobalt oxide spinel, $Co_3O_4$, is understood as having, per molecule, one $Co^{++}$ ion and two $Co^{+++}$ ions to satisfy the valence requirements of four $O^{--}$ ions; thus the single metal cobalt spinel may be illustrated by the emprical formula $Co^{++}Co_2^{+++}O_4^{--}$ to show the stoichiometric valence balance of cobalt cations with oxygen anions.

2. When divalent metal ions are substituted into the cobalt oxide spinel structure, they tend to replace divalent cobalt ions. For example when $Mg^{++}$ is substituted into the $Co_3O_4$ spinel structure, it replaces $Co^{++}$ giving a spinel illustrated by the empirical formula $Mg^{++}Co_2^{+++}O_4^{--}$.

3. When monovalent metal ions are substituted into the cobalt oxide spinel structure they tend to replace divalent cobalt ions. The maximum monovalent ion substitution may be illustrated as, for example, $Li_{0.5}^{+}Co_{2.5}^{+++}O_4$, to show stoichiometric valence balance. The empirical formula may be illustrated as, for example, $Li_yCo_{3-y}O_4$, where y is not more than 0.5, 3-y is at least 2.5, and where (y times Li valence) plus (3-y times cobalt valence) equals 8.

4. When two or more divalent metal ions are substituted into the cobalt oxide spinel structure, then the structure can be written, empirically, as $M_xM'_{x'}Co_{3-(x+x')}O_4$ or as, e.g., $M_xM'_{x'}M''_{x''}Co_{3-(x+x'+M'')}O_4$.

5. When two or more monovalent metal ions are substituted into the cobalt oxide structure, then the structure can be written, empirically, as $Z_yZ'_{y'}Co_{3-(y+y')}O_4$ or as, e.g., $Z_yZ'_{y'}Z''_{y''}Co_{3-(y+y'+y'')}O_4$.

6. When at least one monovalent metal ion and at least one divalent ion are substituted into the cobalt oxide spinel structure, then the structure can be written, empirically, as $M_xZ_yCo_{3-(x+y)}O_4$ or as, e.g., $M_xM'_{x'}Z_yCo_{3-(x+x'+y)}O_4$ or, e.g., as $M_xM'_{x'}Z_yZ'_{y'}Co_{3-(x+x'+y+y')}O_4$.

7. If an excess of monovalent and/or divalent metal ions are present in the mixture from which the substituted cobalt oxide structures are prepared, the excess metal values tend to form a separate metal oxide phase which is not a spinel structure but which is present with the spinel structure.

8. It will be understood by practitioners of these arts that there may be some degree of imperfect spinel crystals which, if they could be isolated and measured separately may not conform exactly to the empirical structures written in this disclosure, but the spinel products prepared according to this invention can be said to conform substantially to the empirical formulae shown.

9. If metal values are in the mixture (from which the spinel structures are formed) which do not effectively replace cobalt ions in the cobalt oxide spinel structure, these metals tend to form separate metal oxide phases which act as modifiers of the spinel structures. For instance, where the spinel structures are formed by building up a contiguous layer of the spinel on a substrate by repeated applications of spinel-forming ingredients, each application being followed by the heating step, the modifier metal oxides are beneficial in providing toughness and abrasion-resistance to the layer. The amount of modifier metal oxides should be limited so that the desired spinel is the predominant ingredient of the coating.

The metals of the relevant groups of the Periodic Table are as follows:

| IA | IIA | IB | IIB |
|---|---|---|---|
| Li | Be | Cu | Zn |
| Na | Mg | Ag | Cd |
| K | Ca | Au | Hg |
| Rb | Sr | | |
| Cs | Ba | | |
| Fr | Ra | | |

Operative upper limits for molar percentage of the M and Z metals which form polymetal spinels with cobalt are, based on total metal content of the spinel: $M \leqq 33.3\%$, $Z \leqq 16.7\%$, and $M+Z \leqq 33.3\%$. Any excess of M and Z will form a separate phase of the metal oxide amongst the spinel crystals. When M metals are used in the coating, it is preferred that on a molar metal basis M is at least 8%. When Z metals are used in the coating, it is preferred that on a molar metal basis Z is at least 4%.

The following examples are to illustrate the invention, but the invention is not limited to the particular embodiments shown.

Experimental

The type of test cell utilized here was a conventional vertical diaphragm chlorine cell. The diaphragm was deposited from an asbestos slurry onto a foraminous steel cathode in the conventional manner. Anode and cathode were each approximately 3"×3" (7.62 cm×7.62 cm). Current was brought to the electrodes by a brass rod brazed to the cathode and a titanium rod welded to the anode. The distance from the anode to the diaphragm face was approximately ¼ inch (0.635 cm). Temperature of the cell was controlled by means of a thermocouple and heater placed in the anolyte compartment. A 300 gpl sodium chloride solution was fed continuously to the anolyte compartment via a constant overflow system. Chlorine, hydrogen, and sodium hydroxide were withdrawn continuously from the cell. Anolyte and catholyte levels were adjusted to maintain an NaOH concentration in the catholyte of about 110 gpl. Power was supplied to the cell by a current-regulated power supply. Electrolysis was conducted at an apparent current density of 0.5 ampere per square inch (6.45 $cm^2$) anode area.

The etching solution employed in the examples below was prepared by mixing 25 ml analytical reagent hydrofluoric acid (48% HF by weight), 175 ml analytical reagent nitric acid (approximately 70% $HNO_3$ by weight), and 300 ml deionized $H_2O$.

Anode potentials were measured in a laboratory cell specifically designed to facilitate measurements on 3"×3" (7.62×7.62 cm) anodes. The cell is constructed of plastic. Anode and cathode compartments are separated by a commercial PTFE membrane. The anode compartment contains a heater, a thermocouple, a thermometer, a stirrer, and a Luggin capillary probe which is connected to a saturated calomel reference electrode located outside the cell. The cell is covered to minimize evaporative losses. Electrolyte is 300 gpl sodium chloride brine solution. Potentials are measured with respect to saturated calomel at ambient temperature (25°–30° C.). Lower potentials imply a lower power requirement per unit of chlorine produced, and thus more economical operation.

EXAMPLE I

Fifteen pieces of ASTM Grade I titanium expanded mesh approximately 3"×3"×0.063" (7.62×7.62×0.16 cm) were dipped in 1,1,1-trichloroethane, air dried, dipped in HF-$HNO_3$ etching solution approximately 30 seconds, rinsed with deionized water, and air dried. The mesh was blasted with $Al_2O_3$ grit to a uniform rough surface and blown clean with air. Two interface coating precursor solutions were prepared as follows: Solution (A) contained 15.1 g of $SnCl_4.5H_2O$ dissolved in 5 ml concentrated reagent HCl and 30 ml technical isopropyl alcohol; Solution (B) contained 2.03 g $SbCl_3$ and 15.1 g $SnCl_4.5H_2O$ dissolved in 5 ml concentrated reagent HCl and 30 ml technical isopropyl alcohol. The active spinel coating precursor, Solution (C), was prepared by mixing appropriate quantities of $Co(NO_3)_2.6H_2O$, $Zn(NO_3)_2.6H_2O$, aqueous $ZrO(NO_3)_2$ solution and deionized $H_2O$ to give a mole ratio of 10 Co:5 Zn:1 Zr.

Five sets of anodes were prepared, each containing three samples. Sample (a) of each set contained no interface coating, and thus serves as a comparative example. Sample (b) contains an interface coating of tin oxide obtained from Solution (A). Sample (c) contains an interface coating of tin and antimony oxides obtained from Solution (B).

All interface coatings were prepared at 450° C. For all samples (b) and (c) the specimens were brushed with the appropriate interface solution, baked in a 450° C. convection oven for about ten minutes, removed and cooled in air about ten minutes. One additonal interface coat was applied in a similar manner. For sets (1) and (2) Sample (a) was given two coats of active spinel at 450° C. while Samples (b) and (c) were being given their two interface coats.

All fifteen anodes were given eight coats of active spinel in the following manner: the substances treated as described above were brushed with solution (C), placed in a convection oven heated to the temperature listed in Table I below, baked for about ten minutes, removed, and cooled in air about ten minutes. Seven additional coats were applied in a similar manner. After all coats were applied and baked, the anodes were given a final bake at 375° C. for about one hour.

Potentials of the fifteen anodes were measured in the laboratory cell described above. The cell was heated to about 70° C. and electrolysis was conducted at an apparent current density of 0.5 ampere per square inch (6.45 $cm^2$) anode area. Results are shown in Table I and FIG. 1. It is apparent that the anodes of the present invention are much less sensitive to preparation temperature than are those of the comparative example.

TABLE I

| SET/ SAMPLE | Bake Temperature (°C.) Interface Coat[1] | Active Spinel[2] | Final Bake | Interface Coat Oxides | Anode Potential[3] |
|---|---|---|---|---|---|
| 1 a* | 450[4] | 450 | 375 | NA** | 1340 |
| b | 450 | 450 | 375 | Sn | 1125 |

TABLE I-continued

| SET/ SAMPLE | Bake Temperature (°C.) Interface Coat[1] | Active Spinel[2] | Final Bake | Interface Coat Oxides | Anode Potential[3] |
|---|---|---|---|---|---|
| c | 450 | 450 | 375 | Sn + Sb | 1112 |
| 2 a* | 450[4] | 425 | 375 | NA | 1188 |
| b | 450 | 425 | 375 | Sn | 1098 |
| c | 450 | 425 | 375 | Sn + Sb | 1089 |
| 3 a* | NA | 400 | 375 | NA | 1102 |
| b | 450 | 400 | 375 | Sn | 1097 |
| c | 450 | 400 | 375 | Sn + Sb | 1092 |
| 4 a* | NA | 375 | 375 | NA | 1095 |
| b | 450 | 375 | 375 | Sn | 1097 |
| c | 450 | 375 | 375 | Sn + Sb | 1089 |
| 5 a* | NA | 350 | 375 | NA | 1090 |
| b | 450 | 350 | 375 | Sn | 1094 |
| c | 450 | 350 | 375 | Sn + Sb | 1094 |

*Comparative example.
**NA means not applied.
[1]Two coats.
[2]Eight coats.
[3]Anode potential is measured in millivolts at 0.5 ASI, 70° C. VS SCE at 25-30° C.
[4]Two coats of active spinel precursor.

EXAMPLE II

A piece of ASTM Grade 1 titanium expanded mesh approximately 3"×3"×0.063" (7.62×7.62×0.16 cm) was dipped in 1,1,1-trichloroethane, air dried, dipped in HF-$HNO_3$ etching solution approximately 30 seconds, rinsed with deionized water, and air dried. The mesh was blasted with $Al_2O_3$ grit to a uniform rough surface and blown clean with air. An interface coating precursor solution was prepared as follows: 1.30 g of $InCl_3.4H_2O$ and 0.009 g $SbCl_3$ were dissolved in 3.2 g concentrated reagent HCl and 20.5 g technical isopropyl alcohol. An active spinel coating precursor, Solution (C), was prepared by mixing appropriate quantities of $Co(NO_3)_2.6H_2O$, $Zn(NO_3)_2.6H_2O$, aqueous $ZrO(NO_3)_2$ solution, and deionized $H_2O$ to give a mole ratio of 10 Co:5 Zn:1 Zr.

The specimen was brushed with the interface solution, baked in a 400° C. convection oven for about ten minutes, removed, and cooled in air about ten minutes. The specimen was then given twelve coats of spinel. Each coat was applied by brushing with spinel coating precursor, baking at 400° C. ten minutes, removed from the oven, and cooling in air about ten minutes. After the twelfth spinel coat had been baked the anode was given a final bake at 375° C. for about one hour.

The anode was placed in a diaphragm chlorine cell as described above and operated for over 1.5 years. The cell was shut down from time-to-time for measurement of the anode potential in the laboratory cell, also described above. The potential of the anode at 0.5 ampere per square inch (6.45 $cm^2$) apparent current density and 70° C., measured versus saturated calomel at 30° C., was 1082 mv prior to start-up, 1104 mv after 0.15 yr. operation, and 1093 mv after 1.5 yr. operation. It thus demonstrated stable operation in long-term service as a chlorine anode.

EXAMPLE III

Other polymetal spinel outer coatings (especially containing $ZrO_2$ dispersed therein) which are effective as anodic material for brine electrolysis and which benefit from the interface layer of oxides of Sn, Sb, Pb, Al, In, or mixtures of these include, for example (approx. values):

| | |
|---|---|
| $Li_{0.5}Co_{2.5}O_4$ | $Li_{0.125}Zn_{0.5625}Cu_{0.1875}Co_{2.125}O_4$ |
| $Li_{0.375}Zn_{0.25}Co_{2.375}O_4$ | $Li_{0.125}Mg_{0.75}Co_{2.125}O_4$ |
| $Li_{0.375}Co_{2.625}O_4$ | $Li_{0.25}Zn_{0.50}Co_{2.25}O_4$ |
| $Li_{0.25}Co_{2.75}O_4$ | $Li_{0.125}Zn_{0.5625}Mg_{0.1875}Co_{2.125}O_4$ |
| $Li_{0.125}Zn_{0.75}Co_{2.125}O_4$ | $Li_{0.125}Co_{2.875}O_4$ |
| $Li_{0.125}Cu_{0.75}Co_{2.125}O_4$ | $ZnCo_2O_4$ |
| $Zn_{0.75}Mg_{0.25}Co_2O_4$ | $Zn_{0.25}Ag_{0.375}Co_{2.375}O_4$ |
| $Zn_{0.5}Co_{2.5}O_4$ | $Zn_{0.25}Co_{2.75}O_4$ |
| $Zn_{0.5}Ba_{0.5}Co_2O_4$ | $Zn_{0.5}Mg_{0.5}Co_2O_4$ |
| $Zn_{0.5}Sr_{0.5}Co_2O_4$ | $Zn_{0.5}Ca_{0.5}Co_2O_4$ |
| $Zn_{0.5}Cu_{0.5}Co_2O_4$ | $Zn_{0.5}Cd_{0.5}Co_2O_4$ |

We claim:

1. An electrically-conductive composite comprising an electrically-conductive substrate, an interface coating, and a monometal or polymetal cobalt spinel outer coating, said interface coating comprising a layer of at least one metal oxide of the group consisting of lead oxide, tin oxide, antimony oxide, aluminum oxide, and indium oxide, said monometal or polymetal cobalt spinel comprising at least one substituted cobalt oxide spinel conforming substantially to the empirical formula $M_xZ_yCo_{3-(x+y)}O_4$, where M is at least one metal of the Groups IB, IIA, and IIB, where Z is at least one metal of Group IA, where x is greater than or equal to zero, but not greater than 1, where y is greater than or equal to zero, but not greater than 0.5, where (x+2y) is greater than or equal to zero, but not greater than 1, and where the amounts of M, Z, and Co are sufficient to substantially satisfy the valence requirements of oxygen in the spinel structure.

2. The composite of claim 1 wherein the substrate comprises a valve metal selected from the group consisting of titanium, tantalium, zirconium, molybdenum, niobium, tungsten, hafnium, and vanadium and alloys thereof.

3. The composite of claim 1 wherein the substrate comprises titanium or alloys thereof.

4. The composite of claim 1 wherein the composite comprises an electrode material.

5. The composite of claim 1 wherein the composite comprises an anode material.

6. The composite of claim 1 wherein the composite comprises an anode in a brine electrolysis cell.

7. The composite of claim 1 wherein M represents one metal, Z represents one metal and (x+2y) equals a value in the range of about 0.5 to about 1.0.

8. The composite of claim 1 wherein M represents two metals and y is zero.

9. The composite of claim 1 where Z represents one metal and x is zero.

10. The composite of claim 1 where Z represents two metals and x is zero.

11. The composite of claim 1 wherein the polymetal cobalt spinel is substantially represented by the empirical formula $ZnCo_2O_4$.

12. The composite of claim 1 wherein the polymetal cobalt spinel is substantially represented by the empirical formula $Li_{0.5}Co_{2.5}O_4$.

13. The composite of claim 1 wherein the coating of monometal or polymetal cobalt spinel contains dispersed therein up to about 50%, on a metal-to-metal molar basis, of at least one modifier selected from the oxides of metals of Groups IIIB, IV-B, V-B, VI-B, VII-B, III-A, IV-A, V-A, Lanthanides, and actinides.

14. The composite of claim 1 wherein the coating of monometal or polymetal cobalt spinel contains dispersed therein up to about 50%, on a metal-to-metal molar basis, a modifier metal oxide comprising $ZrO_2$.

15. The composite of claim 1 wherein the polymetal cobalt spinel coating comprises $ZnCo_2O_4$ containing dispersed therein a minor amount of a modifier metal oxide comprising $ZrO_2$.

16. The composite of claim 1 wherein the interface coating comprises tin oxide, indium oxide, a mixture of tin oxide and antimony oxide, or a mixture of indium oxide and antimony oxide.

17. The composite of claim 1 wherein the interface coating comprises a mixture of indium oxide and antimony oxide and the spinel coating comprises $ZnCo_2O_4$ containing dispersed therein a minor amount of a modifier metal oxide comprising $ZrO_2$.

18. The composite of claim 17 wherein the composite is an anode in a brine electrolysis cell.

19. The composite of claim 17 wherein the composite is an anode material in an electrolytic chloralkali cell.

20. The composite of claim 1 wherein the composite is an electrode.

* * * * *

UNITED STATES PATENT AND TRADEMARK OFFICE

CERTIFICATE OF CORRECTION

PATENT NO. : 4,369,105

DATED : January 18, 1983

INVENTOR(S) : Donald L. Caldwell and Mark J. Hazelrigg, Jr.

It is certified that error appears in the above—identified patent and that said Letters Patent is hereby corrected as shown below:

Col. 2, line 37; "to" should read --do--.

Col. 5, line 19; "emprical" should read --empirical--.

Col. 7, line 40; "additonal" should read --additional--.

Col. 10, line 45, Claim 20; the figure "1" should read --17--.

Signed and Sealed this

*Fifth* Day of *July 1983*

[SEAL]

*Attest:*

GERALD J. MOSSINGHOFF

*Attesting Officer*

*Commissioner of Patents and Trademarks*